US006467744B1

(12) United States Patent
Calin

(10) Patent No.: US 6,467,744 B1
(45) Date of Patent: Oct. 22, 2002

(54) PARTS AND POWER TOOL HOLDER FOR LIFT ARM

(76) Inventor: Adrian Calin, 105 Montgomery Ave., East Norriton, PA (US) 19401

( * ) Notice: Subject to any disclaimer, the term of this patent is extended or adjusted under 35 U.S.C. 154(b) by 0 days.

(21) Appl. No.: 09/932,542

(22) Filed: Aug. 20, 2001

(51) Int. Cl.[7] ..... A47B 96/06
(52) U.S. Cl. ..... 248/214; 248/238
(58) Field of Search ..... 248/214, 215, 248/227.1, 227.4, 231.41, 314, 315; 211/70.6, 133.6, 88.01

(56) References Cited

U.S. PATENT DOCUMENTS

| | | | | | |
|---|---|---|---|---|---|
| 2,958,566 | A | | 11/1960 | Buck | 311/21 |
| 2,962,333 | A | | 11/1960 | Policastro | 311/21 |
| 3,809,349 | A | * | 5/1974 | Baedke | 248/51 |
| 3,998,332 | A | * | 12/1976 | Lambertson | 211/13 |
| 4,480,810 | A | * | 11/1984 | Hall | 248/238 |
| 5,078,281 | A | | 1/1992 | Johnson | 211/88 |
| 5,083,733 | A | * | 1/1992 | Marino et al. | 248/110 |
| 5,547,080 | A | * | 8/1996 | Klimas | 206/373 |
| 5,673,885 | A | * | 10/1997 | Pham | 248/210 |
| 5,699,910 | A | | 12/1997 | Kubat | 206/373 |
| 5,803,422 | A | * | 9/1998 | Buehler | 248/339 |
| 5,937,766 | A | | 8/1999 | Denny | 108/44 |
| 6,041,717 | A | | 3/2000 | Kubat | 108/44 |
| 6,095,057 | A | * | 8/2000 | Corban | 108/42 |
| 7,343 | A1 | * | 7/2001 | Mcelhaney, Jr. | 248/215 |

FOREIGN PATENT DOCUMENTS

GB 2 212 206 A * 7/1989

* cited by examiner

*Primary Examiner*—Ramon O. Ramirez
*Assistant Examiner*—Kofi Schulterbrandt
(74) *Attorney, Agent, or Firm*—Michael F. Petock, Esq.

(57) ABSTRACT

A parts and power tool holder is provided for mounting to an automotive lift wherein the automotive lift may be raised and completely lowered without having to remove the parts and tool holder from the lift. It is comprised of a tray having a bottom surface and a substantially vertically extending sidewall which forms a tray for the automotive parts, small tools and the like. A mounting bracket is mounted to a back portion of the sidewall for mounting of the tray to a lift arm. A holster is provided for hand held power tools formed on the tray adjacent to at least one of the two side portions of the sidewall. The bracket positions the tray such that the tray including the sidewalls is no lower than a plane corresponding to the bottom of the lift whereby the lift may be raised and completely lowered without removal.

10 Claims, 4 Drawing Sheets

FIG. 5
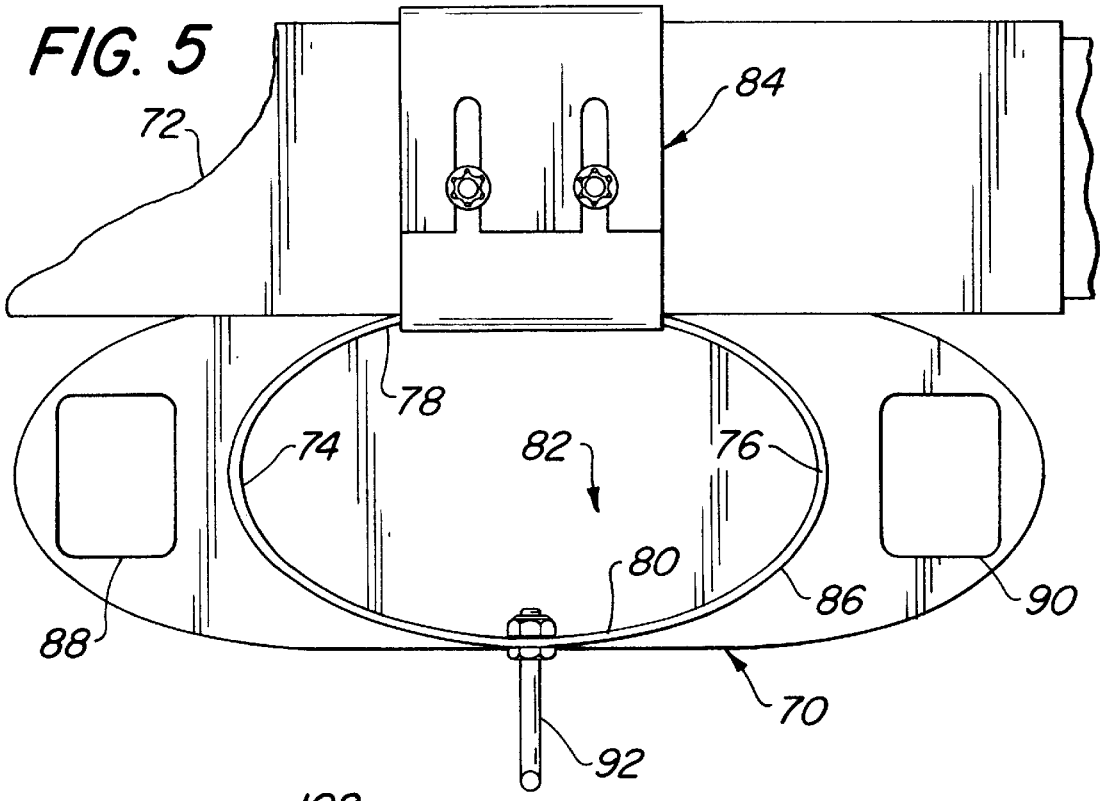
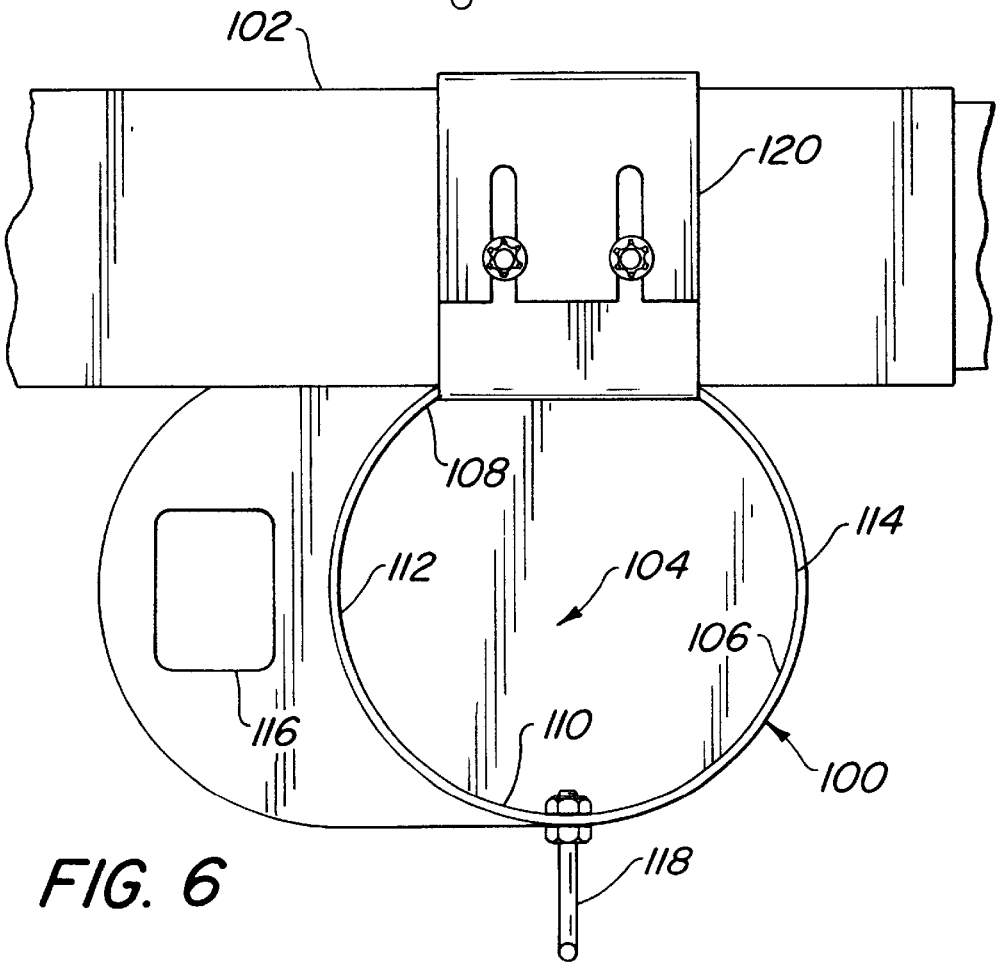
FIG. 6

PARTS AND POWER TOOL HOLDER FOR LIFT ARM

FIELD OF THE INVENTION

The present invention relates to an apparatus for holding parts and tools for use by a mechanic in automotive repair. More particularly, the present invention provides a tray for holding parts and small tools and a holster for power tools which may be attached to the lift arm of an automotive lift.

BACKGROUND OF THE INVENTION

A mechanic working on an automobile or a truck, particularly one which is raised on an automotive lift, has no convenient place to store the various tools which the mechanic is using in the repair process nor to store parts which are being removed such as nuts, bolts, brake springs, other brake components or various other parts. The mechanic has no convenient place to even store hubcaps or center caps. Often, the hubcap or center cap is dropped to the floor, possibly resulting in some minor damage to the hubcap or center cap, and necessitating the mechanic to later bend over to pick up the hubcap from the floor. The same even applies for various parts, such as lug nuts which may have to be dropped to the floor. Further, a power tool such as an air wrench which is used for taking off lug nuts has no convenient storage place, other than to place it on the floor and then having to bend over to pick it up.

Some attempts have been made to address this problem, including the tool and parts tray disclosed by Buehler in U.S. Pat. No. 5,803,422 wherein the Buehler tool and parts tray is adapted for suspension from a cross beam or bar of an automobile vehicle lift. Once this is attached to the cross beam or bar of the automobile vehicle lift, the lift cannot be lowered without removing the tool and parts tray. If the lift were lowered, the tool and parts tray would be damaged, or possibly other damage would result. In a busy automotive repair shop, this is another not insignificant matter that the mechanic has to check for before lowering the lift. Further, the time required to install and uninstall the parts and tool tray each time an automobile is to be worked on is not insignificant. If a tool and parts tray were installed on each of the four arms, the time for installation and removal each time the lift is raised and lowered would be multiplied by a factor of four. Further, the tool and parts tray disclosed in Buehler does not provide any means for storing a power tool.

SUMMARY OF THE INVENTION

An advantage of the present invention is that the parts and tool holder of the present invention may be attached to the lift arm of an automotive lift and does not need to be removed when the lift is lowered.

Another advantage of the present invention is that the parts and power tool holder of the present invention may be somewhat permanently attached to the lift arm.

Another advantage of the present invention is that the parts and power tool holder of the present invention may be attached to the lift arm on the floor before a car or truck is even placed on the lift.

Another advantage of the present invention is that a parts and power tool holder of the present invention may be attached to each of the four lift arms somewhat permanently and left in place as various cars and trucks are placed on the lift, raised, worked on and then the lift is lowered, all without removal of the parts and power tool holder of the present invention, in a repetitive manner.

An advantage of the present invention is that it provides a holder for parts and small tools, as well as a holster for one or more power tools.

Briefly and basically, in accordance with the present invention, an apparatus is provided which comprises a tray having a bottom surface and a substantially vertically extending sidewall forming a holder for holding automotive parts, tools and the like. The sidewall includes a back portion, a front portion and two side portions. A mounting bracket is mounted to the back portion of the sidewall. This bracket is adapted for mounting of the tray to a lift arm of an automotive lift. The sidewall has a vertical height substantially equal to the height of the lift arm. A holster is provided for a hand held power tool formed on said tray adjacent to at least one of the two sidewall portions of said tray. The bracket positions the tray such that the tray including the sidewalls are no lower than a plane corresponding to a bottom of the lift arm whereby the lift arm may be raised or completely lowered without removal of the parts and power tool holder.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 5 is a plan view of another embodiment of the present invention showing a somewhat oval shaped parts tray and a pair of power tool holsters, one on each side of the tray.

FIG. 6 is a plan view of another embodiment of the present invention showing a substantially round parts tray with a power tool holster on the left side.

DETAILED DESCRIPTION OF THE PREFERRED EMBODIMENTS

Figure 1:
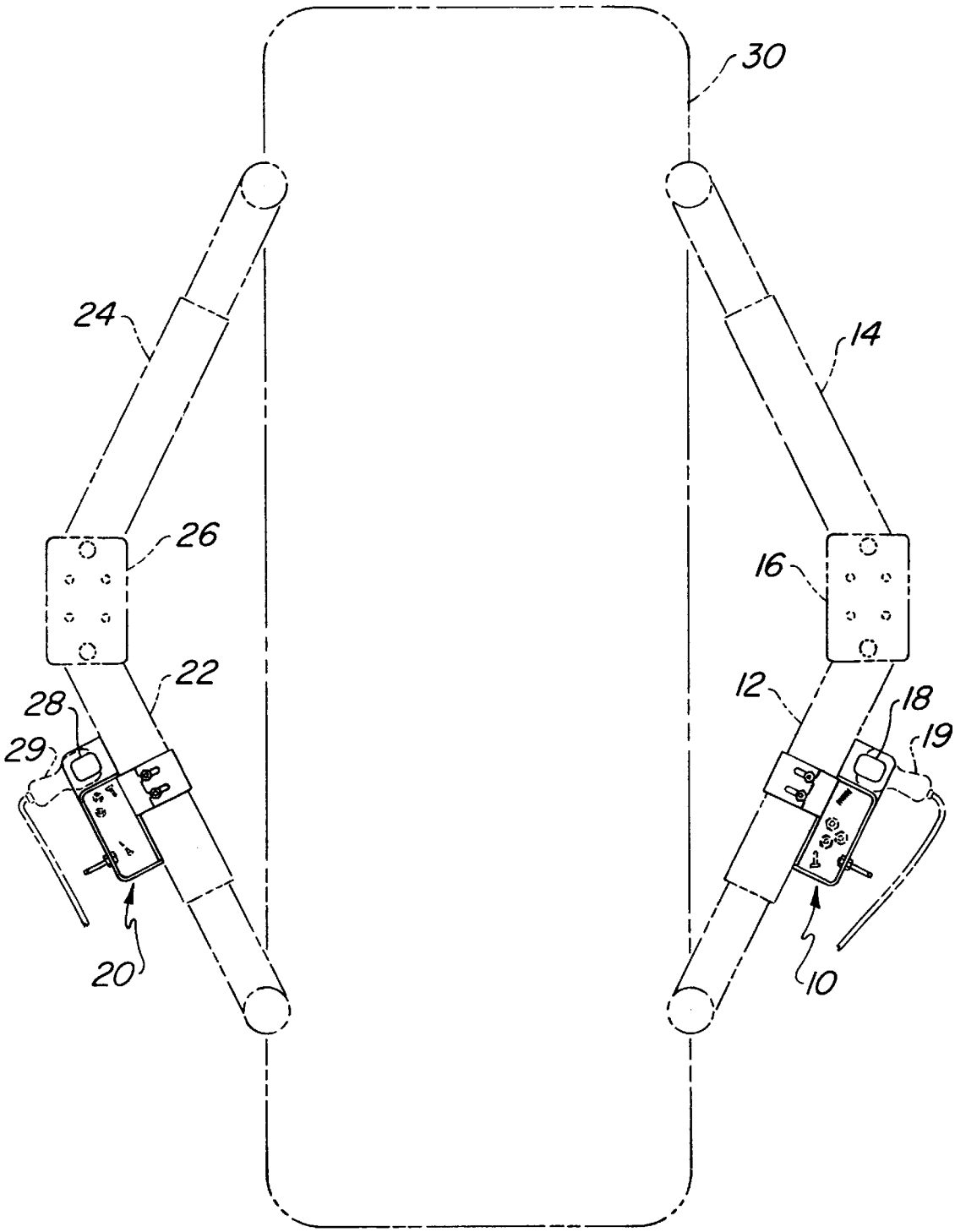
FIG. 1 is a plan view of two parts and power tool holders attached to two lift arms, one having a power tool holster on the left side of the parts and small tools tray and the other being on the other side of the tray.

Referring now to the drawings wherein like numerals indicate like elements, there is shown in FIG. 1 a parts and power tool holder 10 for an automotive lift arm. Parts and power tool holder 10 is mounted to lift arm 12. Lift arm 12 may be any suitable lift arm utilized in connection with the lifting of automotive vehicles such as cars, trucks, buses or any other vehicle. Lift arm 12, as well as lift arm 14, are raised and lowered by a suitable hydraulic lift piston 16 which forms no part of the present invention.

As may be seen in FIG. 1, a power tool holster 18 is formed on the right side of parts and power tool holder 10. Parts and power tool holder 20 is mounted to lift arm 22, and lift arm 22 as well as lift arm 24 are raised and lowered by hydraulic lift piston 26. As may be seen from FIG. 1, parts and power tool holder 20 is provided with a power tool holster 28 on its left side. In other words, the hand held power tool, such as an air wrench, may be mounted on the left or right side of the parts and power tool holder. It may be preferable, for a left handed person to have the power tool holster mounted on the left, and for a right handed person to have the power tool holster mounted on the right. A mechanic may choose for other reasons to select either a left or right hand sided power tool holster. The automotive vehicle on the lift is shown generally at 30 in dotted outline form.

Figure 2:
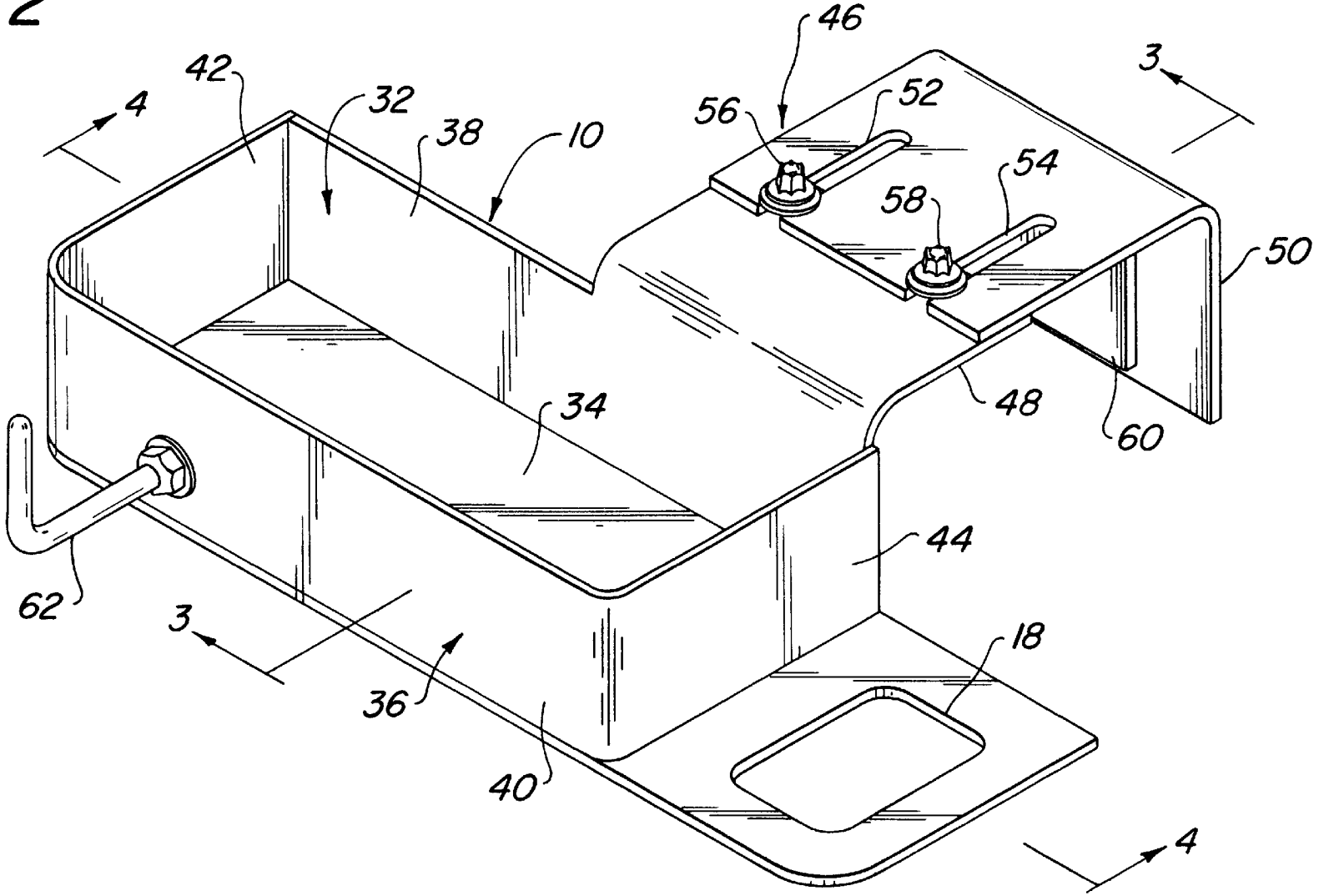
FIG. 2 is a perspective of an embodiment of the present invention.

Referring now to FIG. 2, there is shown parts and power tool holder 10 in greater detail. The embodiment shown in FIGS. 2, 3 and 4 is a presently preferred embodiment, but various other embodiments including circular and oval designs such as those shown in FIGS. 5 and 6 may be utilized.

Figure 3:
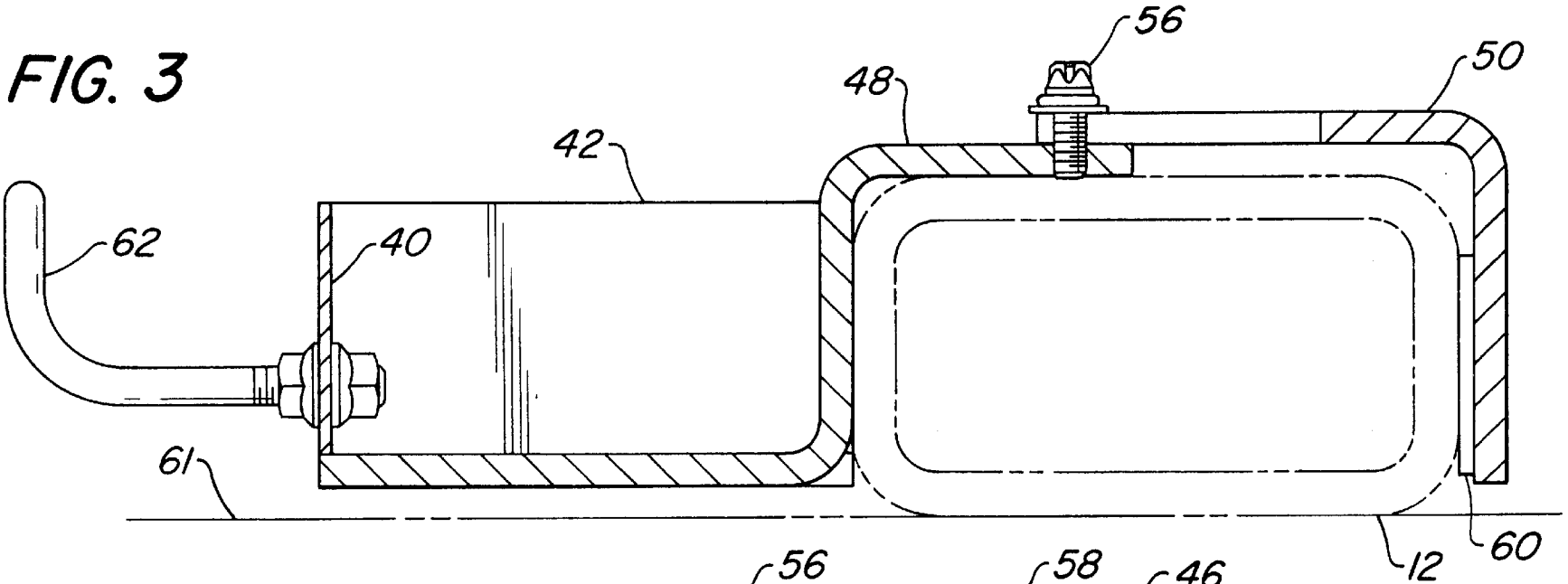
FIG. 3 is a cross-sectional view taken along line 3—3 of FIG. 2.
Figure 4:
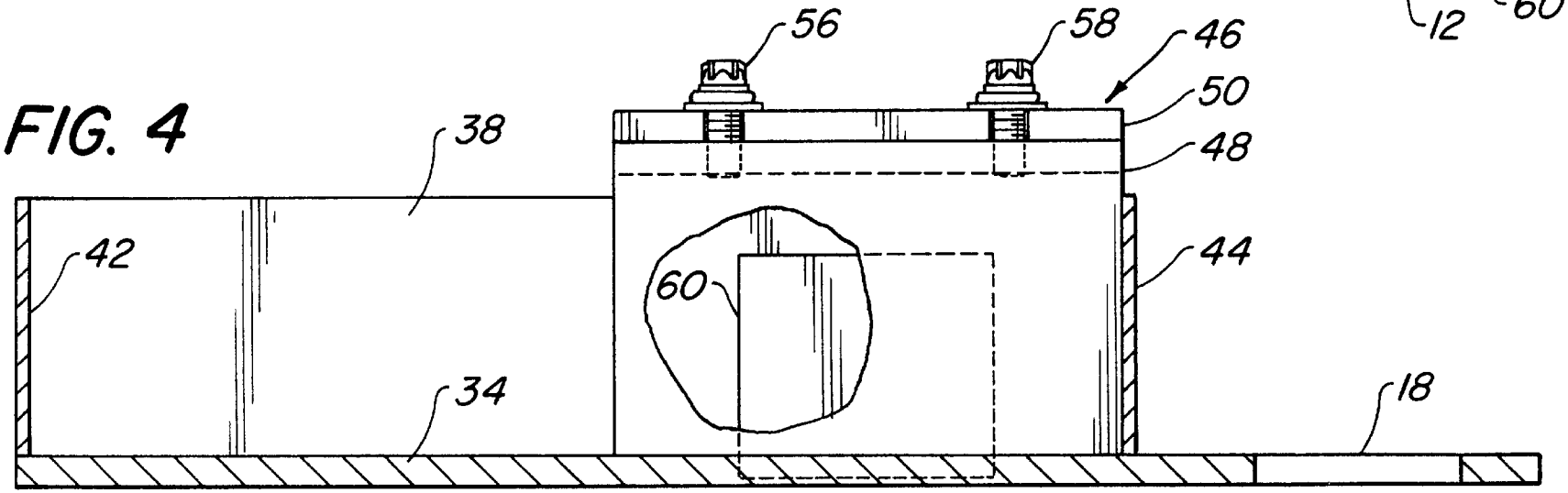
FIG. 4 is a cross-sectional view taken along line 4—4 of FIG. 2.

Referring now more particularly to FIGS. 2, 3 and 4 taken together, there is shown a parts and power tool holder which includes a tray 32 comprised of a bottom surface 34 and a substantially vertically extending sidewall 36. Substantially vertically extending sidewall 36 includes a back portion 38, a front portion 40, a left sidewall portion 42 and a right sidewall portion 44. Tray 32 may be utilized to receive various parts and small tools. Parts such as lug nuts, brake springs, pins, grommets, covers, washers or various other parts and small tools such as screwdrivers and wrenches may be placed in tray 32.

A mounting bracket 46 is comprised of two sections 48 and 50. Section 48 of mounting bracket 46 is mounted or formed to the back portion 38 of sidewall 36. Mounting bracket 46 is adapted to be mounted to the lift arm of an automotive lift as is best illustrated in FIG. 3. FIG. 3 shows the automotive lift arm 12 in dotted outline. Bracket portion 50 is slidably adjustable with respect to bracket portion 48 by reason of slots 52 and 54 formed in bracket portion 50. Bracket portion 50 is locked or secured with respect to bracket portion 48 by locking bolts 56 and 58. The holes in bracket portion 48 are threaded to receive locking bolts 56 and 58. A magnetic strip 60 may be applied to the inside surface of mounting bracket portion 50 to enhance the mounting of mounting bracket 46 to lift arm 12. Magnet 60 may be made of any suitable magnetic material, including magnetic strip material which is commercially available. This may be adhesively bonded to the inner surface of mounting bracket portion 50.

As best illustrated in FIG. 3, mounting bracket 46 positions tray 32, as well as all of the mounting bracket 46, such that it is within the plane of lift arm 12, or at least such that no portion of tray 32 nor mounting bracket 46 extends lower than the lower surface of lift arm 12. A floor surface is illustrated in FIG. 3 by broken line 61. In other words, mounting bracket 46 positions the tray including the sidewall such that the tray and the sidewalls are no lower than a plane corresponding to the bottom of the lift arm whereby the lift arm may be raised and completely lowered without removal of the parts and power tool holder of the present invention.

Continuing to refer to FIGS. 2, 3 and 4 together, there is shown in FIGS. 2 and 4 power tool holster 18 for holding a hand held power tool. Power tool holster 18 is formed on tray 32 adjacent to at least one of the two sidewalls of the tray, and as indicated in FIGS. 2 and 4, it is formed adjacent to right sidewall 44. Power tool holster 18 may preferably be formed as a hole or opening in an extension of bottom surface or plate 34, but it is understood that other ways of formed such a tool holster, including the attachment of a bracket, may be utilized in practicing the present invention.

In FIG. 1 there is shown a hand held power air wrench 19 in holster 18 and a hand held power air wrench 29 in holster 28. However, as discussed with respect to FIG. 1, and as illustrated with respect to parts and power tool holder 20, the power tool holster may be formed adjacent to left sidewall 42, preferably as an extension of bottom surface or plate 34.

As illustrated in FIGS. 2 and 3, a hook 62 may be mounted to front portion 40 of vertical sidewall 36 for the hanging of hubcaps, center caps and the like. Other items may be hung from hook 62. Hook 62 is preferably mounted to front portion 40 of sidewall 36 by having hook 62 pass through a hole formed in the sidewall and hook 62 being bolted in place. However, other means of attaching or forming hook 62 may be utilized, including welding or the use of adhesives. Although not presently preferred, it is understood that the entire parts and power tool holder may be molded of a suitable rigid plastic.

Referring to FIG. 5, there is shown another embodiment of a parts and power tool holder designated as 70 mounted to lift arm 72. Parts and power tool holder 70 illustrates the use of an oval tray 82. Oval tray 82 is provided with a substantially vertical sidewall 86, which like the embodiment of FIGS. 2, 3 and 4 may be considered to have a back portion 78, a front portion 80, a left sidewall portion 74 and a right sidewall portion 76. Parts and power tool holder 70 may be provided with a mounting bracket 84 which may be substantially identical to that described with respect to FIGS. 2, 3 and 4. Parts and Power tool holder 70 is provided with a power tool holster 88 on the left side and a power tool holster 90 on the right side. Power tool holster also is provided with a hook 92 mounted in a manner similar to hook 62.

Referring now to FIG. 6, there is shown another embodiment of the present invention where a parts and power tool holder 100 is mounted to lift arm 102. Parts and power tool holder 100 is provided with a circular tray 104 having a circular sidewall 106 with a back portion 108, a front portion 110, a left portion 112 and a right portion 114. Parts and power tool holster 100 is also provided with a power tool holster 116 mounted on the left side. Obviously, the holster could be mounted on the left or right hand side, or on both sides as illustrated with respect to FIG. 5. Parts and power tool holster 100 is also provided with a hook 118 which is mounted to the front portion 110 in a manner similar to the mounting of hooks 62 and 92. Parts and power tool holster 110 is also provided with a mounting bracket 120 which is substantially identical to mounting bracket 46.

The present invention may be embodied in other specific forms without departing from the spirit or essential attributes thereof and, accordingly, reference should be made to the appended claims, rather than to the foregoing specification as indicating the scope of the invention.

I claim:

1. An apparatus, comprising:

a tray having a bottom surface and a substantially vertically extending sidewall forming a holder for holding automotive parts, tools, said sidewall having a back portion, a front portion and two side portions;

a mounting bracket mounted to said back portion of said sidewall, said bracket being adapted for mounting of said tray to a lift arm of an automotive lift, said mounting bracket extending no lower than a plane corresponding to a bottom of said lift arm;

a holster for a hand held power tool formed on said tray adjacent to at least one of the two sidewall portions of said tray; and said bracket positioning said tray such that said tray including said sidewall are no lower than a plane corresponding to said bottom of the lift arm whereby said lift arm may be raised and completely lowered without removal of said tray from said lift arm.

2. An apparatus in accordance with claim 1 wherein a hook is mounted to said front portion of said sidewall.

3. An apparatus in accordance with claim 1 wherein said bottom surface and said sidewalls are substantially rectangular.

4. An apparatus in accordance with claim 1 wherein said bottom surface and said sidewalls are substantially oval.

5. An apparatus in accordance with claim 1 wherein said bottom surface and said sidewalls are substantially round.

6. An apparatus in accordance with claim 1 wherein said mounting bracket includes a magnet for aiding in attachment of said bracket to said lift arm.

7. An apparatus in accordance with claim 1 wherein said power tool holster is attached to left side of said tray.

8. An apparatus in accordance with claim 1 wherein said power tool holster is attached to the right side of said tray.

9. An apparatus in accordance with claim 1 including a second holster for a hand held power tool such that a holster is adjacent to each of the two sidewall portions of said tray.

10. An apparatus in accordance with accordance with claim 1 wherein said sidewall has a vertical height substantially equal to the height of said lift arm.

* * * * *